US007584851B2

(12) United States Patent
Hong et al.

(10) Patent No.: US 7,584,851 B2
(45) Date of Patent: Sep. 8, 2009

(54) CONTAINER FOR DISK DRIVES

(75) Inventors: Terence Ten Teck Hong, Singapore (SG); Paul Newburn, San Jose, CA (US)

(73) Assignee: Seagate Technology LLC, Scotts Valley, CA (US)

( * ) Notice: Subject to any disclaimer, the term of this patent is extended or adjusted under 35 U.S.C. 154(b) by 461 days.

(21) Appl. No.: 11/216,414

(22) Filed: Aug. 30, 2005

(65) Prior Publication Data

US 2006/0076253 A1 Apr. 13, 2006

Related U.S. Application Data

(60) Provisional application No. 60/617,153, filed on Oct. 8, 2004.

(51) Int. Cl.
*B65D 85/30* (2006.01)
*B65D 81/02* (2006.01)

(52) U.S. Cl. ..... 206/589; 206/523; 206/723

(58) Field of Classification Search ..... 206/521, 206/387.15, 523, 592, 706, 707, 711, 564, 206/589, 723, 725, 454, 486, 509, 588, 307, 206/307.1, 387.1, 499, 587
See application file for complete search history.

(56) References Cited

U.S. PATENT DOCUMENTS 2,783,879 A * 3/1957 Emery ..... 206/443
3,128,030 A * 4/1964 Davies ..... 229/406
3,164,478 A * 1/1965 Bostrom ..... 426/119
3,416,690 A * 12/1968 Michael ..... 217/26.5
3,580,467 A * 5/1971 Pieszak et al. ..... 206/319
3,583,559 A * 6/1971 Brander ..... 206/422
3,756,383 A 9/1973 Kryter
3,835,994 A * 9/1974 Davis et al. ..... 206/499
4,241,830 A * 12/1980 Di Gesu' ..... 206/422
4,593,816 A * 6/1986 Langenbeck ..... 206/425
4,840,276 A * 6/1989 George ..... 206/499
4,860,894 A * 8/1989 Koenig ..... 206/421
5,253,755 A 10/1993 Maenke
5,259,508 A * 11/1993 Beckerman ..... 206/587
5,366,080 A 11/1994 Carstersen et al.
5,706,951 A 1/1998 Oinuma et al.
5,755,332 A 5/1998 Holliday et al.
5,775,508 A 7/1998 Bongard et al.
5,806,286 A * 9/1998 Oinuma et al. ..... 53/472
5,934,463 A 8/1999 Yu
5,993,745 A * 11/1999 Laska ..... 422/104
6,010,007 A 1/2000 Moren et al.

(Continued)

*Primary Examiner*—Mickey Yu
*Assistant Examiner*—Steven A. Reynolds
(74) *Attorney, Agent, or Firm*—Leanne Taveggia Farrell; Westman, Champlin & Kelly, P.A.

(57) ABSTRACT

A shipping container includes a main insert, a top cover and a cardboard or corrugated shell. The container is especially adapted for securing computer disk drives therein. Potential damage to the disk drives is minimized by isolating movement of the disk drives within the container. Each drive is loaded within a compartment defined by surrounding dividers formed on both the top cover and main insert. The overall container height is minimized by incorporating recesses in the inserts that can increase the effective height of exterior cushioning ribs thus reducing the thickness of the floorboard or base member. The incorporation of the recesses results in formation of relatively thin web sections that interconnect base portions of the cushioning ribs to base portions of the dividers.

16 Claims, 6 Drawing Sheets

U.S. PATENT DOCUMENTS

| | | | | |
|---|---|---|---|---|
| 6,116,423 | A | 9/2000 | Troxtell, Jr. et al. | |
| 6,142,304 | A | 11/2000 | Moren et al. | |
| 6,216,885 | B1 * | 4/2001 | Guillaume | 211/85.13 |
| 6,588,595 | B2 | 7/2003 | Levin et al. | |
| 6,786,334 | B2 * | 9/2004 | Smith | 206/592 |
| 6,820,743 | B2 * | 11/2004 | Hurley et al. | 206/427 |
| 6,840,381 | B2 | 1/2005 | Stephens | |
| 6,866,150 | B2 | 3/2005 | Mason et al. | |
| 7,134,553 | B2 | 11/2006 | Stephens | |
| 7,237,675 | B2 * | 7/2007 | O'Malley | 206/433 |
| 2001/0020595 | A1 * | 9/2001 | Koike | 206/521 |
| 2002/0023857 | A1 * | 2/2002 | Smith | 206/588 |
| 2006/0076253 | A1 | 4/2006 | Hong et al. | |

* cited by examiner

CONTAINER FOR DISK DRIVES

CROSS REFERENCE TO RELATED APPLICATION

Priority is claimed from U.S. Provisional Patent Application Ser. No. 60/617,153, filed on Oct. 8, 2004, entitled "Active Beam Shock Protection Package for Multi Disk Drive Shipment" the disclosure of which is incorporated herein by reference in its entirety.

FIELD OF THE INVENTION

The present invention relates to a container or package used for shipment and storage of objects therein, and more particularly, to a container or package especially adapted for shipment and storage of computer disk drives wherein the container protects the drives from vibration and shock that may occur during shipment and storage, yet the container is minimized in size.

BACKGROUND OF THE INVENTION

Computer disk drives are common to personal computers, laptop computers and other computing devices. As with most products, computer disk drives must be shipped from a manufacturer or distributor to another location where the disk drives may be sold or used. As understood by those skilled in the art, computer disk drives are precision electromechanical devices that electronically store data and allow data to be manipulated in accordance with the functioning of the computing devices in which the disk drives are installed. A disk drive includes one or more disks, and at least one read/write component known as the "head" which reads and writes data to and from its corresponding disk. In general, packages or containers for disk drives must provide the proper amount of and support to prevent damage to the drives if the container is dropped or inadvertently contacted by a foreign object. During shipment, a disk drive is shipped with its head in the "landing zone". The landing zone is an area on the disk where the head is positioned when the disk drive is not in use. Refinement in the construction of some disk drives has resulted in fewer and/or smaller heads being used. Accordingly, for these newer types of disk drives, there is oftentimes not enough friction between the smaller heads and the landing zone to prevent the disk from rotating due to vibration or shock during shipment. Vibrations experienced by these types of disk drives during shipment can cause the disks to partially rotate in repetitive back and forth motions. These small, partial rotations of the disks cause the lubrication to be displaced or separated from the ball bearings and bearing races within the spindle motors that drive the disks. The separation of the lubricant from the bearings and races can result in bearing/race damage due to the lack of proper lubrication. This damage is called "motor fret". When a disk drive is installed in a computer, the existence of motor fret may be significant enough to cause increased motor noise. Motor noise is a defect that can make the disk drive unsuitable for sale to a consumer.

The vast majority of disk drives are shipped from a manufacturer in multi-pack boxes, that is, those boxes/containers that hold at least twenty disk drives. These multi-pack containers are then palletized wherein many containers are packed together and strapped to a pallet.

Existing multi-pack containers typically include a corrugated outer carton and inner protective inserts that isolate each of the disk drives within the container. Typically, two inserts are used, namely, a top cover and a main insert. The pair of inserts work together as a pair to protect the drive from shock on all axes. One common insert material used is expanded polypropylene, also known as EPP foam. EPP foam is relatively low in cost and durable, as well as resilient enough to provide good shock and vibration protection. The inserts are molded in a desired configuration to hold the set number of disk drives to be packaged within the container. Most multi-pack containers arrange the disk drives on edge and orient them transversely with respect to a long axis of the container. In this arrangement, every disk drive is visible when the upper insert or top cover is removed. Accordingly, each drive can be accessed individually without having to remove other drives. Individual drive access allows bar code scanning, software loading, etc., while minimizing handling of the drives.

Some structural characteristics common to most if not all inserts include the use of a flat, horizontal plate or floorboard, peripheral vertical side walls that surround the plate or floorboard, and a plurality of partitions or dividers arranged in the space between the vertical sidewalls, gaps or spaces between the dividers forming compartments that receive the disk drives. The purpose of the dividers is to separate each drive from its neighbor so that the drives do not contact one another during shipment. The partitions can be either full or partial height, that is, the partitions can fully cover the drives, or only partially cover the drives thus there being some gap between the inserts. The peripheral edges of the inserts as well as the exposed upper and lower surfaces of the inserts may include a plurality of shock pads or ribs that extend from the floorboard exterior surfaces and contact the inner surfaces of the outer carton that receives the inserts.

When properly designed, the ribs function by compressing to absorb impact energy, and then rebound to essentially their original size and shape. The floorboard itself only serves as secondary cushioning, while primary cushioning is achieved by the externally extending cushioning ribs.

One example of a prior art container for multiple disk drives is disclosed in the U.S. Pat. No. 6,588,595. The container of this invention includes three major components, namely, a main insert, a top cover, and a cardboard shell. The main insert is constructed of expanded polypropylene material molded to include a plurality of compartments to receive disk drives loaded therein. The compartments are arranged in one or more rows extending longitudinally along the length of the package. The top cover is placed over the insert and contacts the upper surfaces of the disk drives. A stabilizing member in the form of a central rib communicates with the top cover and extends longitudinally along the row(s) of the disk drives to partially constrain the disk drives during lateral or transverse movement within their respective compartments. This invention has been proven to greatly reduce or eliminate motor fret.

In addition to providing shock and vibration protection for the disk drives, it is also desirable to provide a container that may be easily shipped and stored according to international shipping standards. More particularly, one key restriction for palletized loads that may be shipped by air is that the loads must fit into an internationally accepted "cube" size. Typically, the cube is 40 inches×48 inches in length and width, and approximately 45 inches maximum in height. Many multi-pack boxes are designed to fit precisely on pallets to minimize wasted space; however, a need still exists for shipping additional disk drives per pallet in order to further minimize shipping and storage costs. However, effective shock and vibration protection should be maintained if a multi-pack box is modified to accommodate the more cost effective shipping and storage.

SUMMARY OF THE INVENTION

In accordance with the present invention, a container or package for multi-disk drive shipping is provided that adequately protects the disk drives from damage, yet reduces the overall size of the container thus enabling more disk drives to be shipped per standard pallet. The primary components of the container include a mating pair of molded inserts and a corrugated or cardboard shell that receives the inserts. One important feature of the present invention is to depart from the traditional practice of using a floorboard of uniform thickness in the inserts, and to restructure the inserts to incorporate a series of alternating recesses and cushioning elements or ribs wherein the pairs of ribs align directly with each drive within the container. The recesses are formed between spaced pairs of cushioning ribs, thereby increasing the effective height of each cushioning rib. Therefore, at the locations of the ribs, the floorboard is essentially eliminated in favor of a thin web or thin extension of the polypropylene material extending between the cushioning ribs. Between each pair of cushioning ribs is a central support beam that extends substantially perpendicular to the pairs of cushioning ribs. Thus, a "fishbone" configuration is achieved between the support beam and the plurality of cushioning ribs. The support beam provides structural rigidity while the recesses allow the cushioning ribs to largely disassociate from the floorboard and perform their cushioning function with minimal restraint from the floorboard. Thus, the overall height of the insert can be reduced because the floorboard height is greatly reduced yet the effective cushioning height of the cushioning ribs is not sacrificed.

Both of the inserts can incorporate the same cushioning rib arrangements, that is, the upper surface of the top cover and the lower surface of the main insert may be configured so that recesses are formed between the cushioning ribs, and a support beam extends between the pairs of cushioning ribs. Thus, the upper and lower surfaces of the inserts may be of identical construction in incorporating cushioning ribs.

Without sacrificing structural integrity and shock/vibration protection, the container of the present invention uses less packaging material and therefore lowers the shipping weight of the container by substantially reducing the mass of the floorboards. Ultimately, shipping costs can be reduced because more containers can be loaded per pallet without exceeding the cube size. Additionally, fewer pallets are required for storage of the disk drives, and thus less warehouse storage space is required.

Other features and advantages of the present invention will become apparent from a review of the drawings, taken in conjunction with the detailed description.

DETAILED DESCRIPTION

Figure 1:
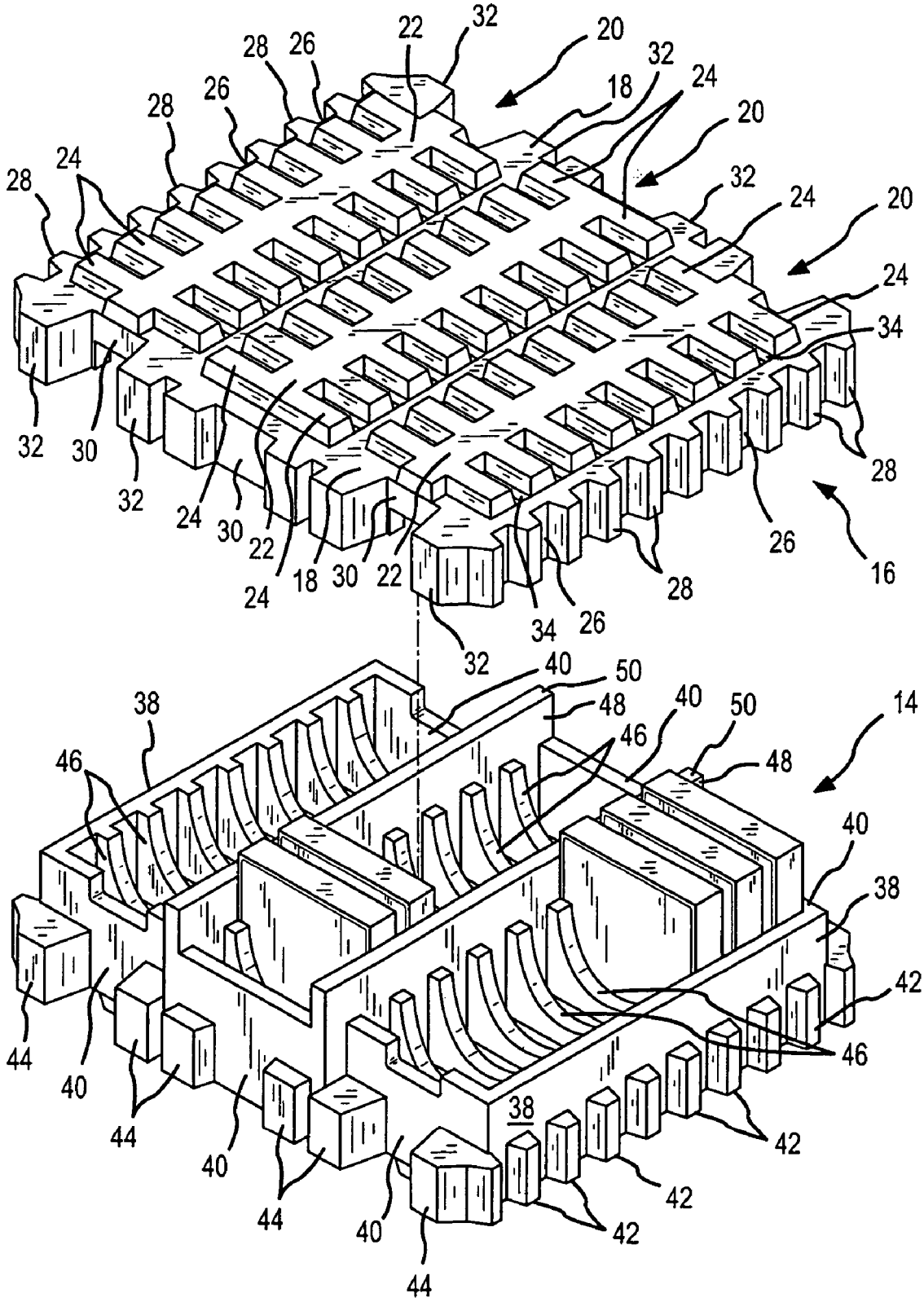
FIG. 1 is a perspective view of the pair of inserts of the present invention.
Figure 2:
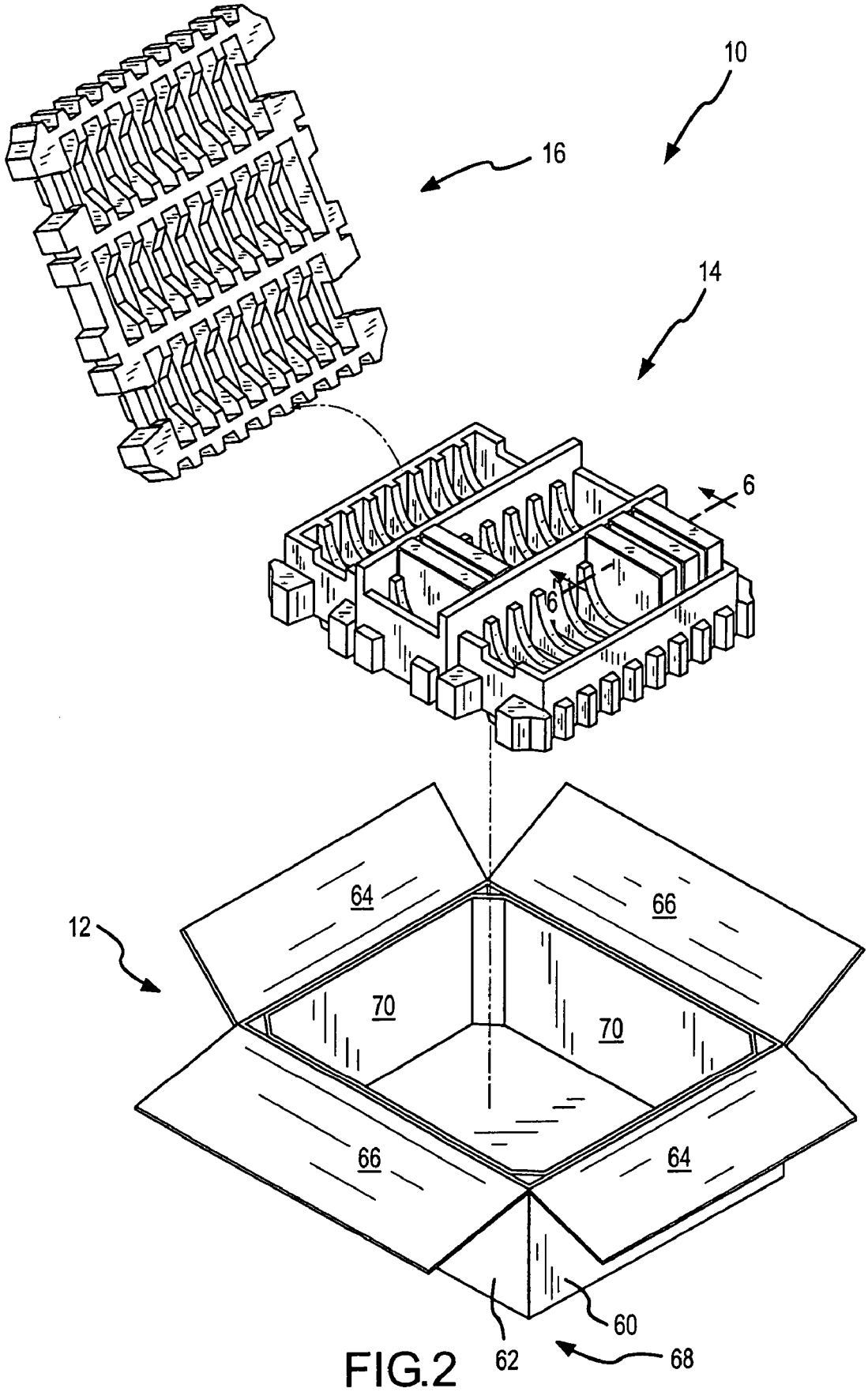
FIG. 2 is a perspective view showing the pair of inserts and the cardboard shell.

FIGS. 1 and 2 illustrate the container 10 of the present invention. As shown, the container 10 includes three major components, namely, a cardboard or corrugated shell 12, a main or first insert 14, and a second insert or top cover 16. A few disk drives D are shown mounted in the main insert.

Figure 3:
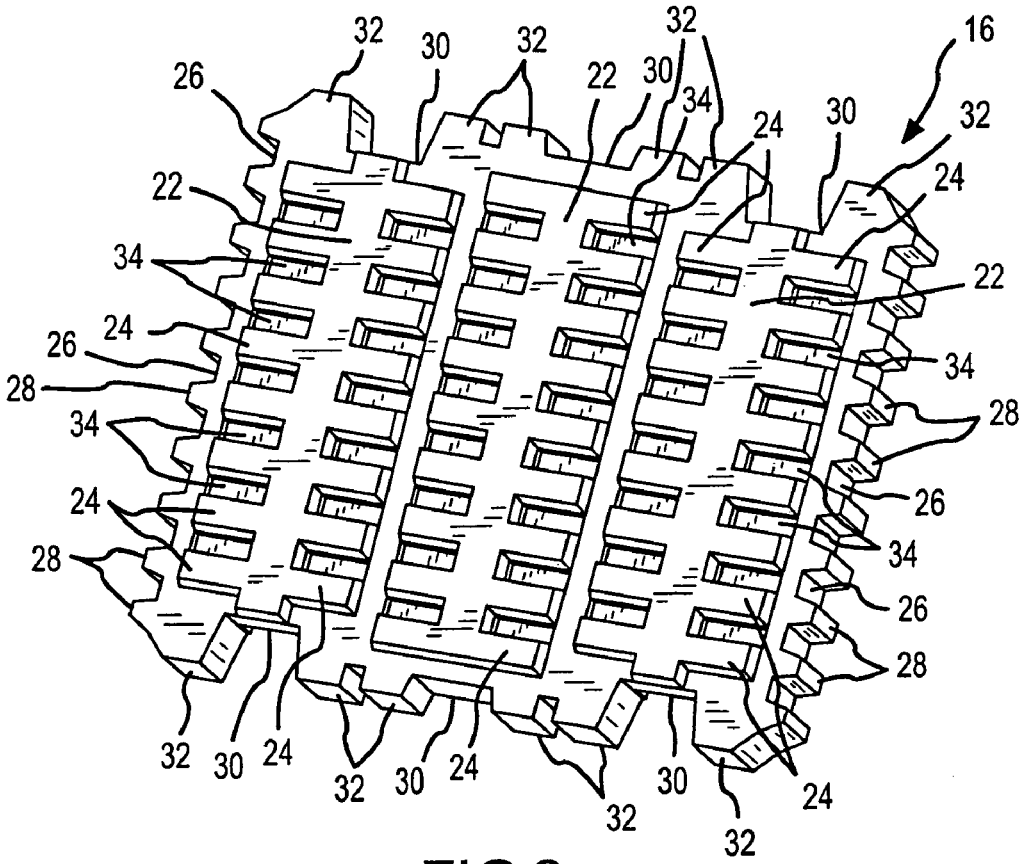
FIG. 3 is a perspective view of the upper surface of the upper insert or top cover, particularly illustrating the plurality of recesses formed in the insert.
Figure 4:
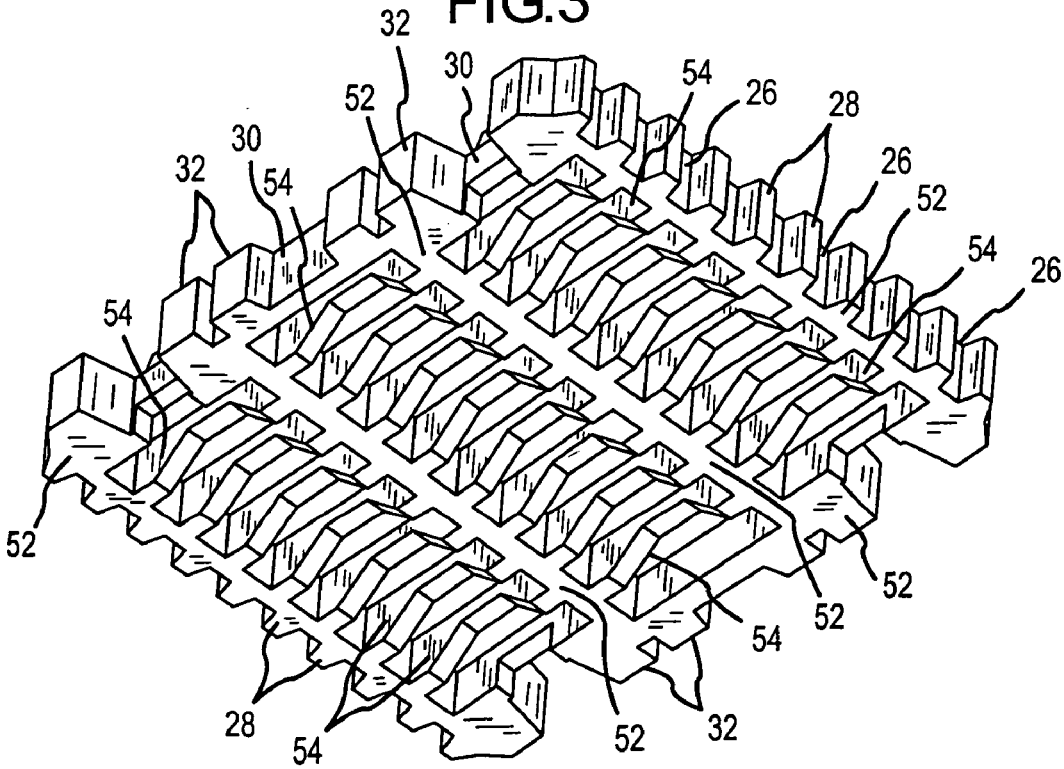
FIG. 4 is a reverse perspective view of the insert of FIG. 3 illustrating the lower surface and the compartments formed by the plurality of dividers or partitions.

Beginning first with a description of the top cover 16, and also referring to FIGS. 3 and 4, this component is characterized by a planar base surface 18 that extends around a periphery or perimeter of the top cover, and extends continuously between rows 20 of cushioning ribs. Each row of cushioning ribs 20 includes a plurality of individual cushioning ribs 24 arranged in opposing pairs. Ribs 24 are spaced from one another by recesses 34 that are formed on the upper planar surface 18. The recesses 34 extend below the planar base surface 18. A central support beam 22 interconnects pairs of cushioning ribs 24, and the beam 22 extends substantially perpendicular to the pairs of cushioning ribs. In the preferred embodiment, the top cover includes three rows 20 of cushioning ribs, and the rows are disposed in a parallel, side-by-side fashion with respect to one another. The top cover 16 further includes a plurality of end cushioning ribs or pads 28 that extend outward from respective end surfaces 26, and a plurality of side cushioning ribs or pads 32 that extend outward from respective side surfaces 30. Each of the cushioning ribs or pads 24, 28, and 32 are shown as having flat exterior surfaces enabling each rib/pad to make flush contact with the interior surfaces of the shell 12.

Referring to FIG. 4, the lower surface 52 of the top cover 16 is illustrated. The lower surface 52 is planar and extends peripherally around the top cover, and between the three rows of dividers/partitions 54. The gaps or spaces between the dividers/partitions 54 define upper compartments that receive upper ends of the disk drives. The dividers/partitions 54 are arranged so that one pair of cushioning ribs 24 is disposed directly above a corresponding compartment. As also illustrated, the dividers/partitions 54 have a trapezoidal shaped cut out; however, it shall be understood that the dividers/partitions 54 can simply be rectangular shaped with a lower surface coplanar with lower surface 52. One purpose for the cutouts is to minimize packaging material, and to ease removal of the drives yet maintain adequate support for the drives.

Figure 5:
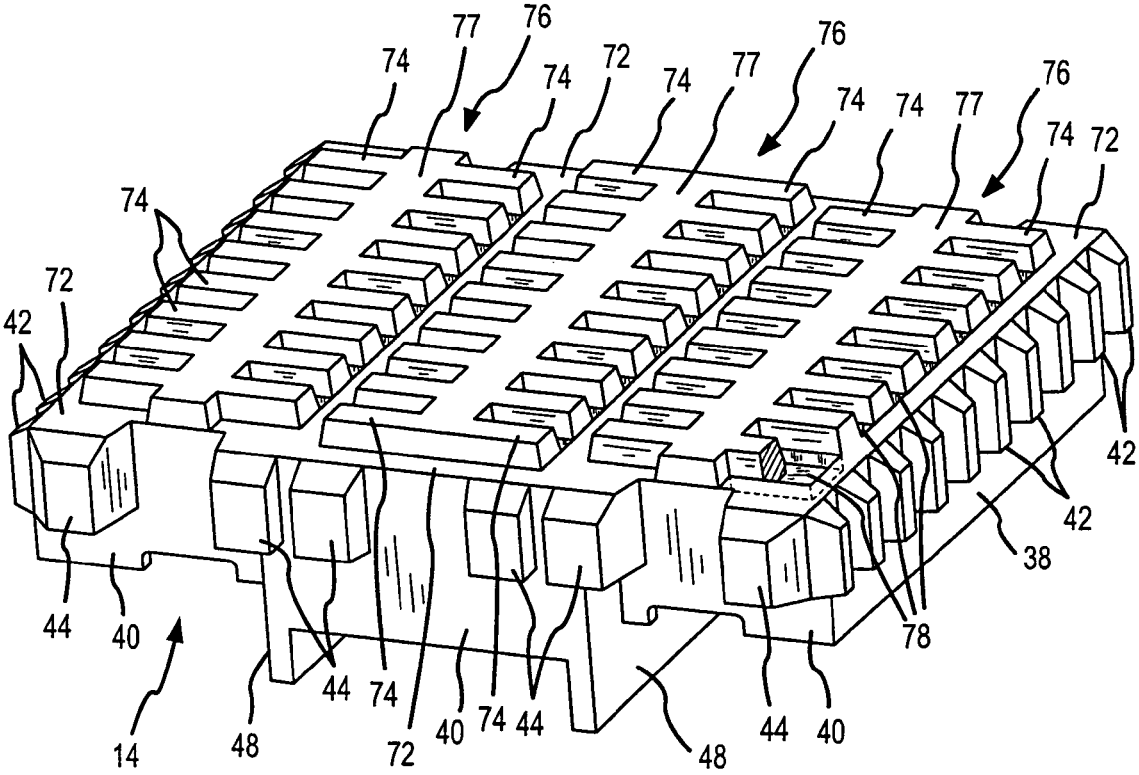
FIG. 5 is a perspective view of the lower surface of the main insert, and showing one support rib broken away to better view a recess formed adjacent the rib.

Referring to FIGS. 1 and 5, the main insert 14 is characterized by a plurality of end cushioning ribs/pads 42 extending from respective end walls 38, and a plurality of side cushioning ribs/pads 44 extending outward from respective side walls 40. Two partition walls 48 divide the main insert into three primary bins, and each bin includes a plurality of spaced dividers/partitions 46. The gaps or spaces between the divider/partitions 46 define lower compartments that receive lower ends of the disk drives. A few disk drives D are illustrated as being placed within lower compartments of the main insert. When the main insert and top cover are placed within the shell 12, the upper surfaces 50 of the partition walls 48 align with and maintain flush contact with the portions of the lower surface 52 that extends between the rows 20 of cushioning ribs. Accordingly, each upper compartment of the top cover aligns with a corresponding lower compartment of the main insert.

Referring to FIG. 5, the lower planar surface 72 of the main insert is illustrated wherein the lower planar surface 72 incorporates the same cushioning rib configuration as the top cover. More specifically, the lower surface 72 is also characterized by a plurality of pairs of cushioning ribs 74 arranged in three rows 76, each pair of cushioning ribs 74 being interconnected by a central support beam 77 that extends substantially perpendicular to the pairs of ribs. A plurality of recesses 78 are formed on the lower surface 72 and between the pairs of cushioning ribs 74. Each pair of cushioning ribs 74 is disposed directly below a corresponding lower compartment of the main insert.

Referring to FIG. 2, the corrugated or cardboard shell 12 may simply be a cardboard box having opposing end walls 60, opposing side walls 62, end flaps 64, and side flaps 66. Optionally, a corrugated insert 70 may be placed within the shell to provide additional structural support to the container. The top cover and main insert are molded in size to fit precisely within the shell 12 wherein the flat exterior surfaces of each of the cushioning ribs 24, 28, 32, 42, and 44 make contact with the interior surfaces of the shell and with the insert 70 if an insert is used.

Figure 6:
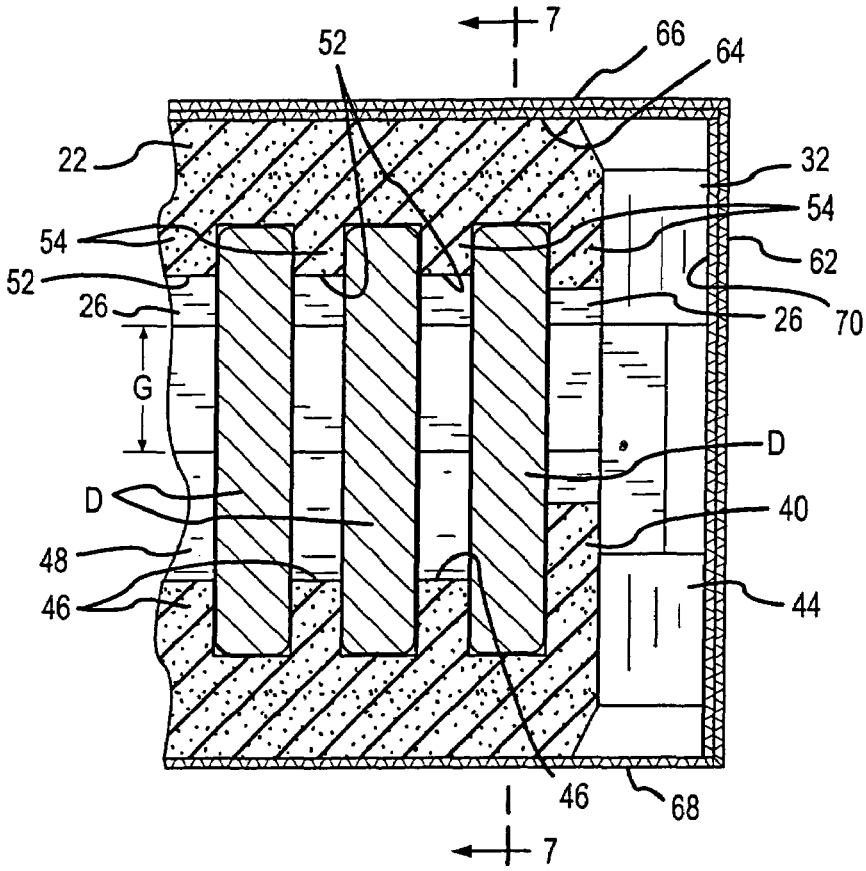
FIG. 6 is a fragmentary vertical section taken along line 6-6 of FIG. 2 illustrating three disk drives mounted within the container.
Figure 7:
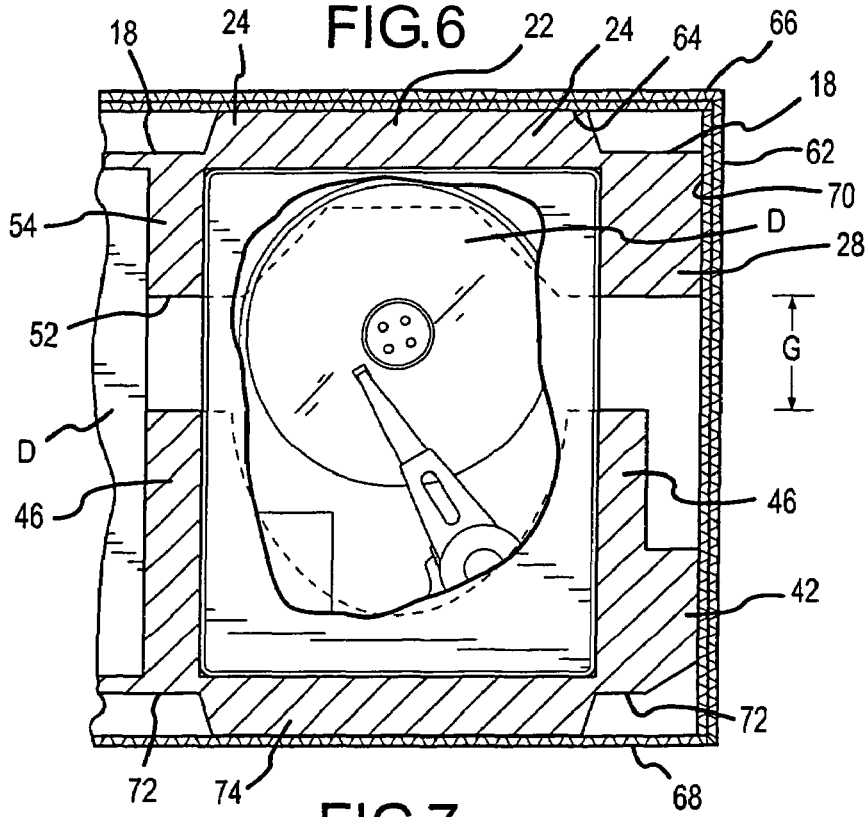
FIG. 7 is a fragmentary vertical section taken along line 7-7 of FIG. 6 illustrating a disk drive mounted within the container.

Referring to FIGS. 6 and 7, a section of the container is shown as being loaded with three disk drives D. As shown, a gap G separates the upper and lower compartments; however, it shall be understood that the dividers/partitions of the top cover and/or main insert may be extended to reduce the size of the gap G or to eliminate the gap G in order to provide necessary support for the disk drives loaded in the container. The disk drives D are typically shipped within sealed flexible bags, and the upper and lower compartments are sized to accommodate the particular size of the drives to include the flexible bags. Preferably, the disk drives within the bags make contact with the interior surfaces of the dividers/partitions. However, it is undesirable for the compartment sizes to be so small that the disk drives must be forced within the compartments thereby deforming the partitions in response to contact with the drives. Thus, a snug fit is desirable without deformation of the partitions.

Figure 8:
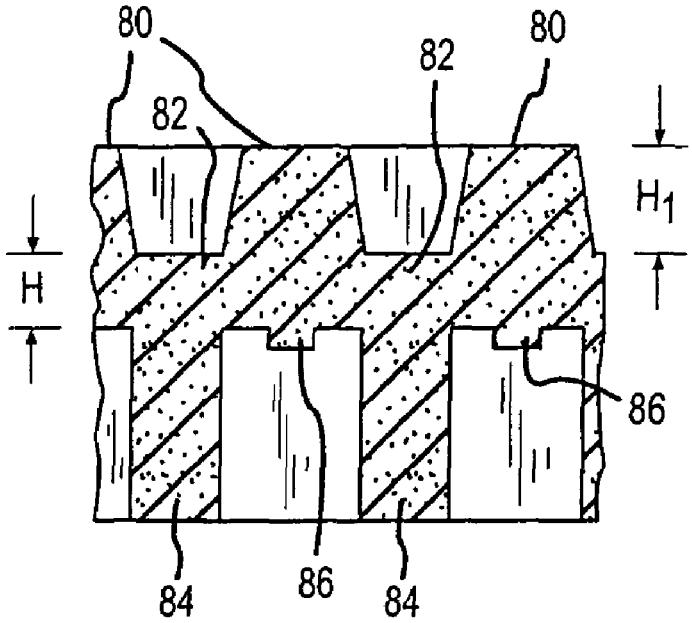
PRIOR ART FIG.8
FIG. 8 is an enlarged fragmentary vertical section of a prior art insert.
Figure 9:
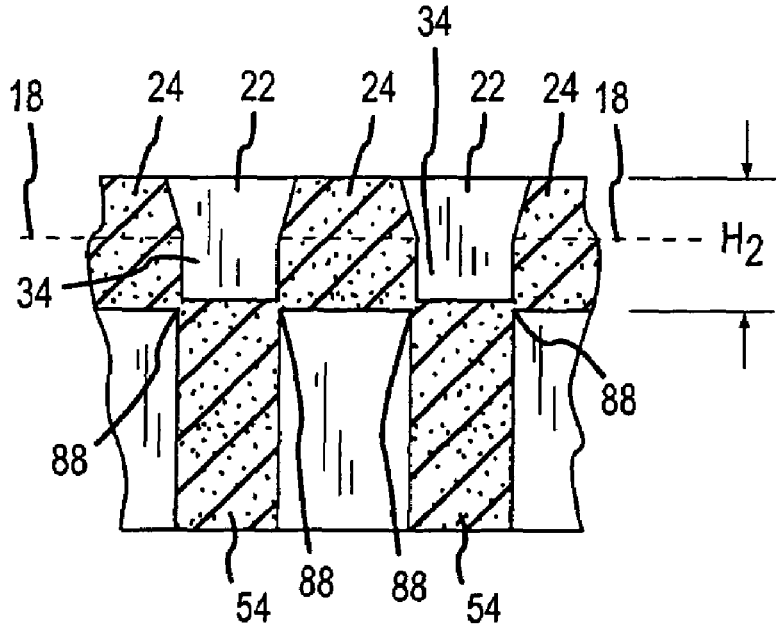
FIG. 9 is an enlarged fragmentary vertical section of the top cover illustrating the arrangement of the recesses and cushioning ribs, and the reduction in overall height of the insert as compared to the prior art of FIG. 8.

Referring to FIGS. 8 and 9, the specific arrangement of the cushioning ribs and recesses of the present invention are contrasted with the cushioning ribs of the prior art. Referring first to the prior art arrangement of an upper insert shown in FIG. 8, the insert includes a plurality of dividers/partitions 84, a floorboard/panel 82, and a plurality of cushioning ribs 80. The prior art arrangement shows the floorboard/panel 82 having a height H, and the overall height of the top cover therefore is greatly influenced by the presence of the relatively thick floorboard 82. The prior art may also include vibration dampers 86 that are protrusions that extend from the upper surface of the compartments. In the top cover of the present invention as shown in FIG. 9, the relatively thick floorboard of the prior art is eliminated in favor of thin web sections 88 which result from incorporation of recesses 34 that extend below the level of the planar upper surface 18. The thin web sections interconnect bases portions of the ribs to base portions of the staggered dividers. Because the relatively thick floorboard has been eliminated, the effective cushioning height of the ribs can be increased without increasing the overall height of the insert. The effective height H1 of a cushioning rib 80 of the prior art is measured from the upper surface of the floorboard 82 to the free end of the rib. The effective height H2 of a cushioning rib 24 of the present invention is measured from the surface defining the lower edge of the recess to the free end of the rib. Since the main insert can incorporate the same configuration as the top cover in terms of the cushioning ribs and recesses, it shall be understood that the discussion above in reference to FIG. 9 and the top cover equally applies to the main insert. Thus, the main insert of the present invention can also be reduced in overall height in comparison to the prior art.

In the present invention, the effective height of a cushioning rib may be greater than the effective height of the prior art, yet the overall height of the insert of the present invention can be made less than the height of the prior art without sacrificing shock and vibration protection. By incorporation of the recesses 34, the cushioning ribs 24 are able to perform their cushioning function within minimal restraint from the interconnecting web sections 88 whereas in the prior art, the cushioning ribs 80 are restrained by the comparatively thick floorboard 82. In testing, it has been found that eliminating the thicker floorboard in favor of thin web sections improves the level of shock protection, despite the overall reduction in insert height.

Although the present invention has been described with respect to three primary components, namely, a pair of inserts and a shell, it shall be understood that in another aspect of the present invention, separate utility exists for use of a single insert. Additionally, while the container of the present invention has been described with respect to advantages in the shipping of products such as disk drives, it shall be understood that the present invention, as well as use of a single insert in other packaging arrangements, can be used to effectively protect other products from damage during shipment. For products that are not as shock and vibration sensitive, a single insert may adequately protect such products. The placement of recesses between cushioning ribs, and the staggered arrangement of partitions and cushioning ribs wherein the ribs are centered over corresponding compartments provides an efficient, cost-effective packaging solution for many products.

For shipment of products like disk drives that are identified by serial number, reduction in size of the containers helps to eliminate hidden labels on fully packed pallets. In shipment of disk drives, a label is typically provided on the exterior surface of the shell with a listing of serial numbers for each of the disk drives packed within the container. This label may include a plurality of barcodes that are scanned to record which particular disk drives are in containers loaded on particular pallets. By reducing the overall size of the container, additional options are made available in stacking the containers on a pallet. One option is to stack containers so that all containers have at least one exposed surface, and this exposed surface of each package could have the label thereon thus allowing one to scan each label without disturbing the stacked containers.

There are many advantages of the present invention in providing a vibration and shock resistant container. The container is minimized in size to maximize product shipments in standard cube sizes, thus reducing shipping costs. For disk drive shipments, the present invention maintains a standard multi-pack box layout thus minimizing required changes to processes for manufacturing the containers. Reduction in size of the containers results in use of less packaging material.

Because more containers can be stacked per pallet, fewer pallets are required and shipping costs are further reduced.

Although the invention has been described with respect to one or more preferred embodiments, it shall be understood that other changes and modifications can be made to the present invention within the spirit and scope of the invention as defined by the claims appended hereto.

What is claimed is:

1. A container for shipping a plurality of devices, comprising:

a shell forming an internal volume defined in part by opposing walls spatially disposed across a substantially constant height of the internal volume;

a first insert having a substantially planar first surface and an opposing substantially planar second surface comprising:

a plurality of rows of first ribs extending from the planar first surface to distal surfaces a plurality of partitions disposed opposite the first ribs to form a plurality of first compartments recessed into the planar second surface, each of the first ribs are aligned with one of the first compartments;

wherein each row of first ribs includes a beam extending in a first direction and interconnecting aligned first and second portions of each first rib in each row, each aligned first and second portions of each first rib are offset from the first and second portions of each first rib in an adjacent row of first ribs;

a second insert having a substantially planar third surface and an opposing substantially planar fourth surface, a plurality of second ribs extending from the planar third surface to distal surfaces, and a plurality of partitions disposed opposite the second ribs to form a plurality of second compartments recessed into the planar fourth surface, each of the second ribs are aligned with one of the second compartments;

wherein the first insert and the second insert are matingly engageable with each other to fit within the internal volume of the shell so that each first compartment aligns with each second compartment to cooperatively define a cavity sized to receivingly engage only one of the devices, and wherein distal surfaces of the opposing first ribs and second ribs are spatially separated by a distance that is substantially equivalent to the height of the internal volume; and wherein the first insert and the second insert include a plurality of first recesses positioned between the first ribs and a plurality of second recesses positioned between the second ribs, the plurality of first recesses recessed into the planar first surface to form the plurality of partitions opposite the first ribs and the plurality of second recesses recessed into the planar third surface to form the plurality of partitions opposite the second ribs.

2. The container of claim 1, wherein a width of the first ribs and the second ribs corresponds with a width of the first compartments and the second compartments, respectively.

3. The container of claim 1, wherein the first compartments and the second compartments are arranged in a plurality of rows extending in the first direction and having a width extending transversely to the first direction.

4. The container of claim 3, wherein the plurality of second ribs comprise a plurality of rows of second ribs, each row extending in the first direction and corresponding with the plurality of rows of the first ribs and including a beam interconnecting aligned first and second portions of each second rib in each row, wherein the aligned first and second portions of each second rib in each row are offset from the first and second portions of each second rib in an adjacent row of second ribs.

5. The container of claim 1, further comprising at least one partition wall extending from and beyond the first compartments, the at least one partition wall contacting the planar fourth surface when the first insert and the second insert are matingly engaged with each other.

6. A container for shipping a plurality of devices, comprising:

a first insert having a substantially planar first surface and an opposing substantially planar second surface comprising:

a plurality of first ribs having proximal ends coupled to the planar first surface and extending from the planar first surface to distal ends;

a plurality of partitions coupled to the planar second surface and disposed opposite the first ribs to form a plurality of first compartments recessed into the planar second surface, each of the first ribs are aligned with one of the first compartments;

a plurality of first recesses positioned between the first ribs, the plurality of first recesses recessed into the planar first surface to form the plurality of partitions opposite the first ribs;

a second insert having a substantially planar third surface and an opposing substantially planar fourth surface comprising:

a plurality of second ribs having proximal ends coupled to the planar third surface and extending from the planar third surface to distal ends;

a plurality of partitions coupled to the planar fourth surface and disposed opposite the second ribs to form a plurality of second compartments recessed into the planar fourth surface, each of the second ribs are aligned with one of the second compartments;

a plurality of second recesses positioned between the second ribs, the plurality of second recesses recessed into the planar third surface to form the plurality of partitions opposite the second ribs;

wherein the first insert and the second insert are matingly engageable with each other so that each first compartment aligns with each second compartment to cooperatively define a cavity sized to receivingly engage only one of the devices; and a shell enclosing the first insert and the second insert when they are matingly engaged with each other.

7. The container of claim 6, wherein a width of the first ribs and the second ribs corresponds with a width of the first compartments and the second compartments, respectively.

8. The container of claim 6, wherein the first compartment and the second compartment are arranged in at least one row extending in a first direction and having a length extending transversely to the first direction.

9. The container of claim 8, wherein the plurality of first ribs comprise a plurality of rows of first ribs, each row of first ribs extending in the first direction and including a beam interconnecting aligned first and second portions of each first rib in each row, wherein the aligned first and second portions of each first rib in each row are offset from the first and second portions of each first rib in an adjacent row of first ribs.

10. The container of claim 9, wherein the plurality of second ribs comprise a plurality of rows of second ribs, each row extending in the first direction and corresponding with the plurality of rows of the first ribs and including a beam interconnecting aligned first and second portions of each second rib in each row, wherein the aligned first and second portions of each second rib in each row are offset from the first and second portions of each second rib in an adjacent row of second ribs.

11. The container of claim 6, further comprising at least one partition wall extending from and beyond the first compartments, the at least one partition wall contacting the planar fourth surface when the first insert and the second insert are matingly engaged with each other.

12. A container for shipping a plurality of devices, comprising:

a shell forming an internal volume defined in part by opposing walls spatially disposed across a substantially constant height of the internal volume;

a first insert having a substantially planar first surface and an opposing substantially planar second surface, a plurality of first ribs extending from the planar first surface to distal surfaces, and a plurality of partitions coupled to the planar second surface and disposed opposite the first ribs to form a plurality of first compartments spaced from one another and arranged in at least one row extending in a first direction, each of the first ribs are aligned with one of the first compartments and having a length extending transversely to the first direction;

a second insert having a substantially planar third surface and an opposing substantially planar fourth surface, a plurality of second ribs extending from the planar third surface to distal surfaces, and a plurality of partitions coupled to the planar fourth surface and disposed opposite the second ribs to form a plurality of second compartments, each of the second ribs are aligned with one of the second compartments;

wherein the first insert and the second insert are matingly engageable with each other to fit within the internal volume of the shell so that each first compartment aligns with each second compartment to cooperatively define a cavity sized to receivingly retain and isolate each dimension of each of the devices from each other, and wherein distal surfaces of the opposing first ribs and second ribs are spatially separated by a distance that is substantially equivalent to the height of the internal volume; and wherein the first insert and the second insert comprise a plurality of first recesses positioned between the first ribs and a plurality of second recesses positioned between the second ribs, the plurality of first recesses recessed into the planar first surface to form the plurality of partitions opposite the first ribs and the plurality of second recesses recessed into the planar third surface to form the plurality of partitions opposite the second ribs.

13. The container of claim 12, wherein a width of the first ribs and the second ribs corresponds with a width of the first compartments and the second compartments, respectively.

14. The container of claim 12, wherein the plurality of first ribs comprises a plurality of rows of first ribs, each row of first ribs extending in the first direction and including a beam interconnecting aligned first and second portions of each first rib in each row, wherein the aligned first and second portions of each first rib in each row are offset from the first and second portions of each first rib in an adjacent row of first ribs.

15. The container of claim 14, wherein the plurality of second ribs comprise a plurality of rows of second ribs, each row extending in the first direction and corresponding with the plurality of rows of the first ribs and including a beam interconnecting aligned first and second portions of each second rib in each row, wherein the aligned first and second portions of each second rib in each row are offset from the first and second portions of each second rib in an adjacent row of second ribs.

16. The container of claim 12, further comprising at least one partition wall extending from and beyond the first compartments, the at least one partition wall contacting the planar fourth surface when the first insert and the second insert are matingly engaged with each other.

* * * * *

UNITED STATES PATENT AND TRADEMARK OFFICE

CERTIFICATE OF CORRECTION

PATENT NO. : 7,584,851 B2
APPLICATION NO. : 11/216414
DATED : September 8, 2009
INVENTOR(S) : Hong et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 541 days.

Signed and Sealed this

Fourteenth Day of September, 2010

David J. Kappos

David J. Kappos
*Director of the United States Patent and Trademark Office*